US005341453A

United States Patent [19]

Hill

[11] Patent Number: 5,341,453

[45] Date of Patent: Aug. 23, 1994

[54] APPARATUS AND METHODS FOR REALISTIC CONTROL OF DC HOBBY MOTORS AND LAMPS

[76] Inventor: Norman M. Hill, 17417 28th Ave. SE., Bothell, Wash. 98012

[21] Appl. No.: 720,231

[22] Filed: Jun. 25, 1991

[51] Int. Cl.[5] ..... H02P 5/00

[52] U.S. Cl. ..... 388/815; 388/928.1; 104/300; 104/DIG. 1; 318/4

[58] Field of Search ..... 318/107, 3, 4, 9, 10–15; 388/809–815; 104/300, 301, 302, DIG. 1

[56] References Cited

U.S. PATENT DOCUMENTS

| | | | |
|---|---|---|---|
| 1,805,167 | 6/1928 | Fitzgerald . | |
| 2,872,879 | 5/1954 | Vierling | 318/107 |
| 3,024,739 | 3/1962 | Smith et al. | 318/107 |
| 3,525,915 | 8/1970 | Barter . | |
| 3,541,416 | 11/1970 | Woyton . | |
| 3,705,387 | 12/1972 | Stern et al. | 318/561 X |
| 3,964,701 | 5/1975 | Kacerek . | |
| 3,994,237 | 11/1976 | Thomsen . | |
| 4,051,783 | 10/1977 | Caliri . | |
| 4,062,294 | 12/1977 | Cohen . | |
| 4,085,356 | 4/1978 | Meinema . | |
| 4,734,628 | 3/1988 | Bench et al. | 318/599 X |

OTHER PUBLICATIONS

"Power Pack Roundup", Model Railroader, J. Hediger, Jan. 1991.

Tech and "Tech II 3" advertisement; Model Railroader, Jan. 1991.

*Primary Examiner*—William M. Shoop, Jr.
*Assistant Examiner*—David Martin
*Attorney, Agent, or Firm*—Hughes & Multer

[57] ABSTRACT

The specification describes a controller apparatus for a DC motor and a lamp having a filament electrically connected in parallel with the DC motor, comprising: (a) an output driver circuit for generating a DC power signal, where the DC power signal energizes the DC motor; (b) an AC signal generating circuit for generating an AC power signal; and a high frequency coupling transformer for so adding the AC power signal to the DC power signal that the AC power signal energizes the filament. Preferably, the controller also comprises: (a) a switching circuit for periodically preventing the DC power signal from controlling the DC motor; (b) a speed sensing circuit for determining a speed of the locomotive by measuring a back EMF signal generated by the DC motor during the time that the switching means prevents the DC power signal from controlling the DC motor; and (c) an error correcting circuit for correcting the DC power signal based on the speed of the locomotive.

22 Claims, 7 Drawing Sheets

TO / FROM FIG. 5B 108
112
116
118
DCPWR
ACPWR
C10
+18v
Q6
Q7
212
208
210
214
R24
C8
C9
190
TO / FROM FIG. 5C
+18v
R16
R18
R15
R17
192
R14
C6
196
198
194
188
204
200
206
186
C7
R21
202
+3.9v
R20
R19
R22
D4
R23
110

SENCLK
+12v
0v
≈2ms
17ms

DCPWR
(BEMF)
DC
DRIVE
-Varm

GATE
+18v
-Varm

ACTSPD
Varm

ACPWR
HIGH
AMPLITUDE
LOW
AMPLITUDE

TRKDRV
Veff
0v

APPARATUS AND METHODS FOR REALISTIC CONTROL OF DC HOBBY MOTORS AND LAMPS

TECHNICAL FIELD

The present invention relates to the realistic control of DC motors and, more particularly, to controllers for DC motors having lamps connected in parallel therewith, such as those used in scale model trains.

BACKGROUND OF THE INVENTION

The present invention may be employed to control DC motors in a variety of settings. The present invention is particularly effective at controlling DC motors of scale model trains, and that application of the present invention will be described in detail herein. However, in its broadest form, the present invention may be applied in any setting where control of the speed of a DC motor is relatively critical, especially when the motor is connected in parallel with an element, such as the filament of an electric lamp, the resistance of which may vary. Thus, while the following discussion discusses the present invention in terms of model railroading, the scope of the invention is defined in the appended claims and not the following detailed description.

In the hobby of model railroading, the hobbyist attempts to model an entire town and set it into motion. Such towns are replete with buildings, roads, vegetation, and cars all manufactured to scale and painstakingly assembled and decorated to achieve a high level of realism.

Central to these towns is the model railroad system itself. Such systems comprise tracks, gates, switches, bridges, and model locomotives and rail cars. These components of the model railroad system are normally built to the same scale as the surrounding town. Additionally, the hobbyist takes excruciating care to ensure that the physical appearance of these components matches the physical appearance of the full size train upon which the model train is based. Again, the hobbyist's goal is to construct a system that appears realistic in the smallest detail.

In addition to having a realistic appearance, a model locomotive is designed with the goal of operating in a realistic fashion. The scale model locomotive is not per se part of the invention, but will be described herein to the extent necessary for a complete understanding of the present invention.

Basically, a typical scale model locomotive comprises: (a) a main frame, (b) a DC electric motor mounted on the main frame, (c) front and back truck assemblies rotatably mounted onto the main frame, (d) first and second sets of metal wheels rotatably attached to the truck assemblies, (e) a drive transmission for transferring the rotational output of the DC motor to the wheels, and (f) one or more lamps mounted on the main frame.

Depicted in FIG. 1 is a schematic diagram showing the electrical system 2 of a typical model locomotive. As shown in this Figure, a motor 4 is electrically connected in parallel to two lamps 6. The motor 4 comprises an armature 4*a* that may be represented in an equivalent circuit as a resistance (Ram), an inductance (Larm), and a DC voltage source (Varm). The lamp 6 comprises a filament 6*a* having a resistance of Rlamp. Indicated schematically at 8*a* and 8*b* are first and second sets of wheels respectively.

These locomotives are precision devices and contain little or no space for additional components.

In operation, the locomotive is placed on the tracks, which are metal, so that the wheels contact the tracks. A DC power signal, either voltage or current, is then applied to the tracks. Because the tracks and wheels are metal, current flows through one of the left or right tracks, through the corresponding set of wheels, into the DC motor 4, through the other set of wheels, and through the other of the left or right tracks, thereby controlling the DC motor 4. When the DC motor 4 is energized, an output shaft of the DC motor 4 rotates, which in turn rotates the wheels 8*a,b* through the drive transmission to move the locomotive. Current also flows through and energizes the filament 6*a* of the lamp 6 when the motor is energized.

By varying the levels of the DC power on the track, the speed of the locomotive can be varied. Ideally, these levels could be varied to achieve a range of speeds of the model locomotive corresponding to a speed range of 1–100 mph. Normally, the DC power signal is within the range of 0–14 volts.

PRIOR ART

A number of power packs for providing a variable DC power signal that may be applied across model train tracks are known. These power packs generally fall into one of two categories: rheostat type power packs and DC type power packs.

Depicted in FIG. 2 is a schematic diagram of a rheostat type controller 10 as is known in the art. This controller 10 basically comprises a DC power supply 12, a rheostat 14, a direction switch 16, and a terminal block 18. The terminal block 18 comprises two terminals 18*a* and 18*b* one of which is connected to a first track T1 and the other of which is connected to a second track T2.

In operation, the locomotive is placed on the tracks so that the first set of wheels 8*a* contacts either the first or second track T1 or T2 and the second set of wheels 8*b* contacts the other of the tracks T1 and T2. The DC power supply generates a fixed +14 V signal. The rheostat 14 is attached in series with a load connected across the terminals 18*a* and 18*b*. By turning a throttle knob of the rheostat 14, a DC power signal may be varied to vary the speed at which the output shaft of the DC motor 4 rotates.

The direction switch 16 is a two position switch connected so that polarity of the terminals 18*a* and 18*b* may be switched. During operation, switching the polarity of the terminals 18*a* and 18*b* changes the direction of rotation of the output shaft of the motor 4. Accordingly, the direction in which the train moves may be changed by selecting One or the other of the positions of the direction switch 16.

Referring now to. FIG. 3, a prior art DC type controller 20 is shown. This DC controller 20 essentially comprises a variable DC voltage source 22, a direction switch 24, and a terminal block 26 comprising terminals 26*a* and 26*b*. By turning a throttle knob on the voltage source 22, the output voltage of this source 22 is varied in an essentially linear fashion from 0 to +14 volts. When the circuit 2 is connected across the terminals 26*a* and 26*b* through the tracks T1 and T2 and wheels 8*a* and 8*b*, this varying output voltage causes the rotational speed of the output shaft of the DC motor 4 to vary. The directional switch 24 is a two position switch that operates in basically the same manner as the directional switch 16 of the rheostat type controller 10 described above.

Several problems with the rheostat and DC type power packs described above prevent the model locomotive powered thereby from operating in a realistic manner.

First, the high levels of friction inherent in the engines of these locomotives causes them to start and stop unrealistically. Specifically, locomotive transmissions typically comprise universal joints, worm gears, and roughly eight other internal gears for transmitting the rotation of the motor output shaft to the wheels. These components cause a relatively high level of friction within the locomotive engine.

Therefore, when accelerating the locomotive, the level of the track signal must be increased until the friction inherent in the engine is overcome, at which point the locomotive breaks loose and unrealistically accelerates to a speed corresponding to the high level of the track signal. Similarly, this friction causes the locomotive to stop unpredictably when it is decelerating. Thus, the friction inherent in the engine causes the acceleration and deceleration of the locomotive powered by the prior art power packs to be highly unrealistic.

Second, the friction of the universal joint varies substantially with the drive angle of the locomotive. The locomotive thus moves fast through straightaways and slows down during curves. This varying friction of the universal joint therefore also renders unrealistic the operation of the locomotive.

Third, a typical model railroad layout contains switches, crossovers, and grades, all of which cause unpredictable or irregular loading on the locomotive. For example, a track power signal that avoids stalls on the uphill side of a hill may cause the locomotive to move too fast on the downhill side of the hill. These irregularities in the typical layout thus also cause the operation of the locomotive to be unrealistic.

Fourth, because the filaments of the lamps 6 are connected in parallel across the DC motor 4, the lamps brighten, dim, and go out as the DC power signal driving the DC motor varies. This variation in the lamp output results in the appearance of the locomotive being very unrealistic.

In an attempt to overcome the above-noted problem with overcoming the friction of the locomotive engine, controller designers have modified the DC type controller so that the DC power signal generated thereby is pulsed. Theoretically, the bursts of power provided by this pulse modulated DC track power signal will overcome the friction in the engine to cause the .model locomotive to accelerate and decelerate realistically. However, the actual improvement in locomotive performance is modest with a pulsed DC power supply. Additionally, the application of a pulse modulated DC power signal causes the DC motor to emit an annoying buzzing sound.

Another attempt to overcome the friction of the locomotive engine provides the user with an adjustable "breakaway voltage". This breakaway voltage, which usually may be adjusted between 1–3 VDC, is added to the DC power signal. The track power signal is thus at the level of this breakaway voltage when the throttle knob indicates zero. However, the actual track power signal necessary to overcome the friction in the engine varies with different operating conditions. Therefore, the breakaway voltage set by the operator is often different from the actual voltage needed to overcome the friction, and the locomotive operates unrealistically.

Other features found in many modem power packs are momentum and braking simulation circuits. These circuits simulate the effects of momentum and braking on the acceleration and deceleration of a full-size train to make the movement of the model train appear more realistic. More particularly, a momentum circuit generally comprises an RC circuit that delays the rise of the DC power signal. This delay is designed such that the model train gradually builds up speed. A braking circuit is a similar RC circuit which delays the fall of the DC power signal so that the model train slows down gradually. However, these momentum and braking simulation circuits do not properly simulate the effects of momentum and braking because of the above-noted problems created by friction in the locomotive engine.

A search of patent and other literature turned up the following references.

U.S. Pat. No. 3,994,237, issued Nov. 30, 1976 to Thomsen illustrates one example of a pulsed DC power source. Generally, the Thomsen patent discloses superimposing a pulsed signal on a ramped DC track power signal during acceleration and deceleration of the train while the ramped voltage is below a selectable maximum magnitude. Above this maximum magnitude, a constant magnitude DC track power signal is applied to operate the model engine at a constant speed. The Thomsen device renders the operation of the locomotive only marginally more effective and causes the DC motor to emit a buzzing sound.

U.S. Pat. No. 4,062,294, issued Mar. 17, 1976 to Cohen, discloses modulating the DC track signal with an AC signal to bypass impurities on the track by ionization. These impurities might otherwise cause loss of contact between the wheels and the track. Flywheels and all-wheel pickup are now commonly employed in locomotive engines. These elements substantially eliminate the effect of loss of contact on locomotive operation, and bypassing impurities on the track is of little concern in increasing the realism of the locomotive.

The following references discovered in the search are no more relevant, and are probably less relevant, than those discussed above and will be listed herein without further discussion: (a) U.S. Pat. No. 1,805,167 issued Jun. 25, 1928 to Fitzgerald; (b) U.S. Pat. No. 4,051,783 issued Oct. 4, 1977 to Caliphates; (c) U.S. Pat. No. 3,964,701 issued May 27, 1975 to Kacerek; (d) U.S. Pat. No. 3,525,915 issued Aug. 25, 1970 to Barter; (e) U.S. Pat. No. 3,541,416 issued Nov. 17, 1970 to Woyton; (f) an article entitled "Power Pack Roundup" in the January 1991 issue of *Model Railroader* magazine; and (g) an advertisement for "TECH II" TM and "Tech 3" power packs in the January 1991 issue of Model Railroader magazine.

OBJECTS OF THE INVENTION

From the foregoing, it should be clear that one object of the present invention is to provide controller apparatus and methods for supplying power to DC motors of model trains to cause these trains to operate in a realistic fashion.

Other important, but more specific, objects of the present invention are to provide controller apparatus and methods for supplying power to a DC motor that:

(a) control the DC motor of a model train so that the model train smoothly starts and stops;

(b) control the DC motor of a model train so that the speed of the train is not substantially affected by unpredictable and irregular loading on the train;
(c) control a lamp connected in parallel to the DC motor regardless of whether or not the DC motor is energized;
(d) regulate the rotational speed of the DC motor without providing components in the locomotive of the model train to measure directly the speed of the locomotive;
(e) energize a lamp connected in parallel to the DC motor to stabilize the resistance of the filament of the lamp so that an accurate measure of a back EMF signal generated by the armature of the DC motor can be made;
(f) control the DC motor such that an incremental increase in rotational speed of the DC motor is lower at lower rotational speeds than at higher rotational speeds;
(g) do not require a modification to a model train locomotive containing the DC motor;
(h) employ a back EMF signal generated by the DC motor even though non-linear elements such as lamps are connected in parallel with the motor; and
(i) implement momentum and braking simulation circuits that cause accelerate and decelerate a model train containing the DC motor-in a realistic fashion.

SUMMARY OF THE INVENTION

These and other objects are achieved by the present invention, which in its most basic form comprises: (a) means for generating a DC power signal, where the DC power signal energizes the DC motor to move the locomotive; (b) switching means for periodically preventing the DC power signal from controlling the DC motor; (c) means for determining a speed of the locomotive by measuring a back EMF signal generated by the DC motor during the time that the switching means prevents the DC power signal from controlling the DC motor; and (c)means for correcting the DC power signal based on the speed of the locomotive.

Further, the present invention my comprise means for setting an operator control signal corresponding to a desired speed of the model train. In this case, the speed determining means generates an actual speed signal indicative of the actual speed of the model train. The correcting means generates a difference signal corresponding to a difference between the actual speed signal and the operator control signal and adds the difference signal to the operator control signal to generate a drive control signal. The DC power signal generating means generates the DC power signal based on the drive control signal.

In another form, the present invention my comprise: (a) means for setting an operator control signal having a linear relationship with a desired speed of the model train; and (b) means for so generating the drive control signal based on the operator control signal that an incremental increase in the speed of the model train is more gradual at lower desired speeds than at higher desired speeds.

If the locomotive further comprises a lamp having a filament electrically connected in parallel with the DC motor, the present invention preferrably comprises means for stabilizing the resistance of the filament. The stabilizing means preferably comprises: (a) means for generating an AC power signal; and (b) means for so adding the AC power signal to the DC power signal to form the track drive signal that the AC component of the track drive signal energizes the filament. Normally, the amplitude of the AC power signal is modulated based on the magnitude of the DC power signal such that the total power supplied to the filament is substantially constant over time.

In another basic form, the present invention comprises: (a) means for generating a DC power signal, where the DC power signal energizes a DC motor; (b) means for generating an AC power signal; and (c) means for so adding the AC power signal to the DC power signal that the AC power signal energizes a filament electrically connected in parallel with the DC motor. This invention preferably further comprises: (a) switching means for periodically preventing the DC power signal from controlling the DC motor; (b) means for determining a speed of the locomotive by measuring a back EMF signal generated by the DC motor during the time that the switching means prevents the DC power signal from controlling the DC motor; and (c) means for correcting the DC power signal based on the speed of the locomotive.

The present invention may alternatively be embodied in a method of providing power to a scale model locomotive having a DC motor, comprising the steps of: (a) generating a DC power signal based on a speed signal, where the DC power signal energizes the DC motor; (b) periodically preventing the DC power signal from controlling the DC motor; (c) generating an actual speed signal indicative of a speed of the locomotive, where the actual speed signal is generated by measuring a back EMF signal generated by the DC motor during the time that the DC power signal is prevented from controlling the DC motor; and (d) adjusting the speed signal based on the actual speed signal.

DETAILED DESCRIPTION OF THE PREFERRED EMBODIMENT

Figure 1:
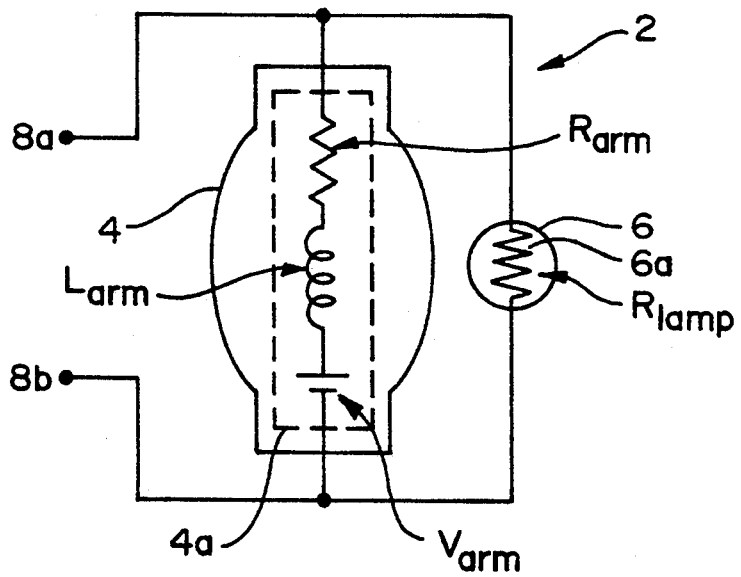
FIG. 1 depicts a schematic diagram of an electrical system of a typical model train locomotive.
Figure 2:
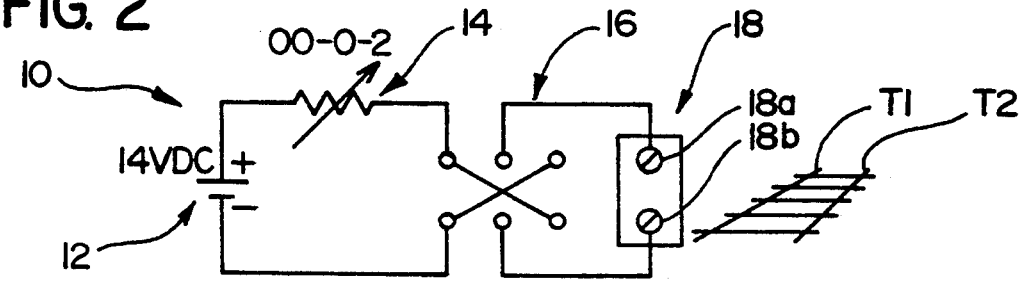
FIG. 2 depicts a schematic of a typical prior art rheostat-type controller.
Figure 3:
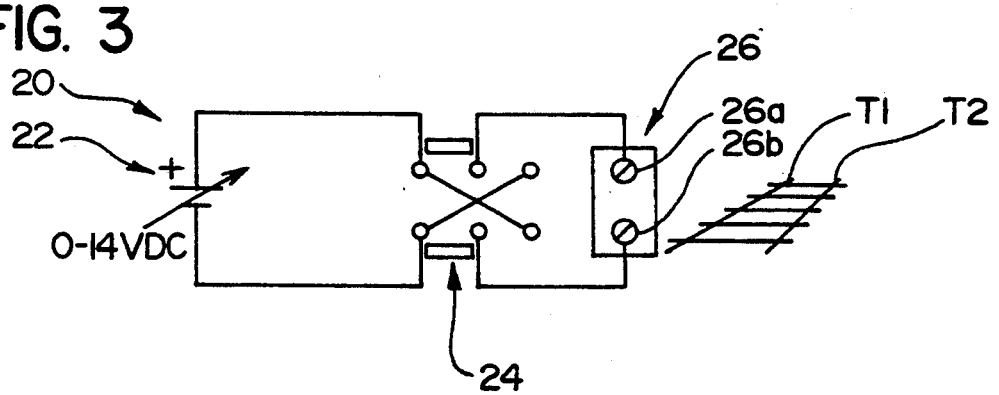
FIG. 3 depicts a schematic of a typical prior art DC-type controller.
Figure 4:
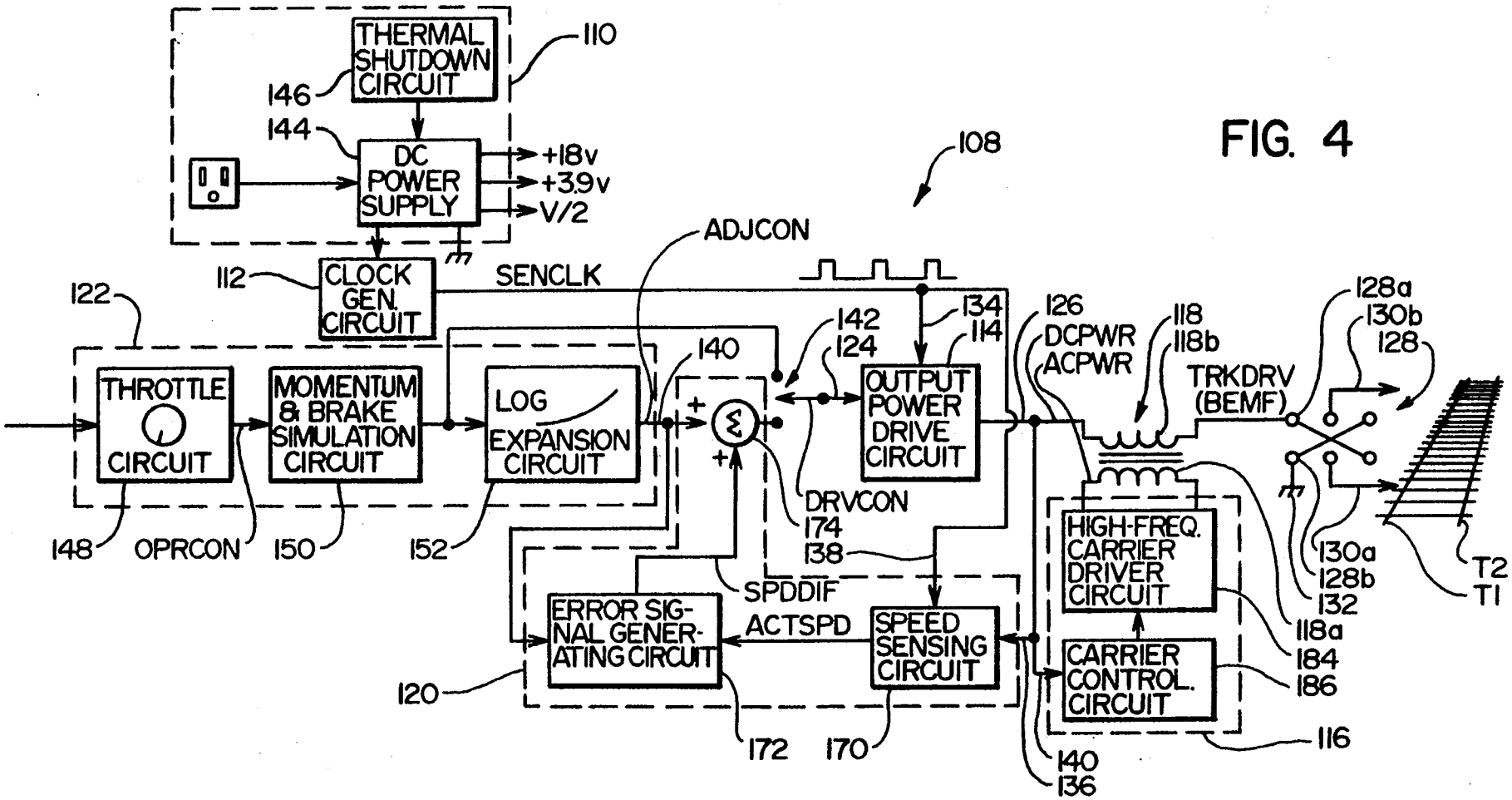
FIG. 4 depicts a block diagram of an electrical system of a preferred embodiment of the present invention.

Depicted in FIG. 4 is a block diagram of an electrical system 108 of a controller for scale model trains embodying, and constructed in accordance with, the principles of the present invention.

This electrical system 108 basically comprises: (a) a power supply circuit 110; (b) a clock generator circuit 112; (c) an output power driver circuit 114; (d) an AC signal generating circuit 116; (e) a high frequency transformer 118; (f) an error correcting circuit 120; and (g) a speed control circuit 122.

This system 108 operates in the following manner. A drive control signal (DRVCON) enters the output power driver circuit 114 through a conductor 124. Based on this drive control signal (DRVCON), the output power driver circuit 114 generates a corresponding DC power signal (DCPWR). This DC power signal (DCPWR) is applied through a conductor 126 into a winding 118*a* of the transformer 118.

A track drive signal (TRKDRV) leaves this winding 118*a* and is applied through a polarity switch 128 and either terminal 130*a* to track T1 or terminal 130*b* to track T2. The other of the tracks T1 and T2 is connected to a ground point 132 through the polarity switch 128. When the wheels 8*a* and 8*b* are placed on the tracks T1 and T2, the DC component of this track drive signal (TRKDRV) energizes the motor 4 to move the locomotive. The motor 4 will ignore any AC component of the track drive signal (TRKDRV).

The clock generating circuit 112 generates a sense clock signal (SENCLK) which enters the output power driver circuit 114 through a conductor 134. This sense clock signal (SENCLK) is a periodic pulsed signal. During the time the sense clock signal (SENCLK) is HIGH, the output power driver circuit 114 is prevented from generating the DC power signal (DCPWR) and enters a high impedance state.

Therefore, as the motor 4 is operating, the motor 4 is not energized during each pulse of the sense clock signal (SENCLK). During these pulses, the locomotive is effectively coasting, and the armature 4*a* of the motor 4 generates a back EMF signal (BEMF). If no non-linear elements are present in the system, the magnitude of back EMF signal (BEMF) is proportional to the rotational speed of the output shaft of the motor 4. This back EMF signal (BEMF) is thus proportional to the speed of the locomotive.

This back EMF signal is transmitted back through the switch 128 and the transformer 118 and into the error correcting circuit 120 through a conductor 136. The sense clock signal also enters the error correction circuit 120 through a conductor 138. The error correcting circuit 120 determines the speed of the locomotive by measuring the back EMF signal (BEMF) when the sense clock is HIGH. This circuit 120 then corrects an adjusted control signal (ADJCON) generated by the speed control circuit 122 to generate the drive control signal (DRVCON). This adjusted control signal (ADJCON) enters the error correcting circuit 120 through a conductor 140.

At the same time, the AC signal generating circuit 116 generates an AC power signal (ACPWR) which is added to the DC power signal (DCPWR) through the high frequency transformer 118 to obtain the track drive signal (TRKDRV). This circuit 116 generates the AC power signal based on the amplitude of the DC power signal (DCPWR), which enters the AC signal generating circuit 116 through a conductor 140.

More particularly, this circuit 116 varies the amplitude of the AC power signal (ACPWR) according to the following equation:

$$V_{AC} = \sqrt{V_{eff}^2 - V_{DC}^2} \quad (1)$$

where VAC is the voltage level of the AC power signal (ACPWR), VDC is the voltage level of the DC power signal (DCPWR), and Veff is the desired effective voltage level of the track drive signal (TRKDRV) applied to the filament 6*a*. In the present invention, Veff is +12 V and VAC and VDC vary within the range of 0 to +12 V. A plot of the curve generated by this equation (1) is a quarter circle, as indicated by reference character C in FIG. 6.

Accordingly, the magnitude of the AC power signal (ACPWR) varies with the magnitude of the DC power signal (DCPWR) such that the true RMS voltage level of the track drive signal (TRKDRV) is substantially constant over time.

The track drive signal (TRKDRV) thus comprises an AC component corresponding to the AC power signal (ACPWR) and a DC component corresponding to the DC power signal (DCPWR). The motor 4 is energized by the DC component but ignores the AC component, while the lamp 6 is energized by both the AC and DC components. Since the total power of the track drive signal (TRKDRV) is substantially constant over time, the power delivered to the lamp 6 is constant over time.

At least two goals are accomplished by providing constant power to the lamp 6. First, the lamp 6 does not flicker and/or go out when the level of the DC power signal (DCPWR) fluctuates. Thus, the lamp 6 operates in a more realistic fashion.

Second, the resistance of the filament 6*a* of the lamp 6 is stabilized. I have recognized that this resistance should be stabilized for the back EMF signal (BEMF) to be accurately and easily measured.

More particularly, the resistance of the filament 6*a* (Rlamp) is non-linear, being a function of the power supplied thereto. This resistance Rlamp normally varies in the range of approximately 5–50 Ω. On the other hand, a typical motor 4 can be represented by an equivalent circuit having attached in series a resistor (Ram) with a value of 10 Ω, an inductor (Larm) with a value of 2 mH, and a DC voltage source (Varm) in the range of 0 to 10 V. Since the lamp is connected in parallel to the motor 4, the variations in the resistance of resistor Rlamp greatly affect the voltage across the motor terminals, which corresponds to the back EMF signal (BEMF).

The present invention provides substantially constant voltage to the lamp 6. This constant voltage stabilizes the resistance Rlamp, allowing a consistent and accurate measurement of this back EMF signal (BEMF).

In the following discussion, the power supply circuit 110, clock generator circuit 112, high frequency transformer 118, polarity switch 128, and a switch 142, which are all well-known circuits and/or components, and will be discussed herein only to the extent necessary for a complete understanding of the present invention. After the brief discussion of these known components, the novel components and features of the present invention will be described separately in further detail.

The power supply circuit 110 generates constant DC voltages +18 V and +3.9 V. These voltages are employed as necessary by each of the other circuits in the controller of the present invention. As shown in FIG. 4, the power supply circuit 110 basically comprises a DC power supply 144 for generating these constant DC voltages and a thermal shutdown circuit 146 for turning off the power supply 142 in the event that the power supply 142 overheats.

The clock generator circuit 112 of the preferred embodiment generates the sense clock signal (SENCLK) with a frequency of 60 Hz and a duty cycle of 30%. These values are preferred; however, the frequency may be between 30 Hz and 240 Hz and the duty cycle may be between 10% and 60% for correct operation of the controller of the present invention. The design of a clock generator circuit 112 that operates within these parameters is well within the ability of one of ordinary skill in the art.

The high frequency transformer 118 and polarity switch 128 are both standard, off-the-shelf, components. The transformer 118 is a step-up transformer having a winding ratio of 1:2, with the signal generated by the AC signal generating circuit 116 flowing through its primary windings 118*a*. The secondary windings 118*b* of the transformer 118 are connected between the above-mentioned conductor 126 and a terminal 128*a* of the switch 128. A terminal 128*b* of the polarity switch 128 is connected to the reference point 132.

So connected, the high-frequency transformer allows a high-frequency AC voltage, in this case the AC power signal, connected across the primary windings 118*a* to be superposed on, or added to, a DC voltage signal, in this case the DC power signal (DCPWR), connected across the secondary winding 118*b*. The resulting signal is the track drive signal (TRKDRV). The polarity switch 128 allows a signal on the secondary windings to be applied selectively either to the track T1 or the track T2.

The switch 142 allows the operator selectively to introduce or remove the error correcting circuit 120 and part of the speed control circuit 122 from the overall circuit. With these circuits removed, the controller of the present invention operates in a manner similar to the prior art power packs described above. This switch 142 thus allows the operator to compare the operation of the controller of the present invention with that of the prior art power packs.

The output power driver circuit 114, the AC signal generating circuit 116, the error correcting circuit 120, and the speed control circuit 122 will now be discussed in further detail.

I. Speed Control Circuit

As shown in FIG. 4, the speed control circuit I22 basically comprises: (a) a throttle circuit 148 which allows the operator to generates an operator control signal (OPRCON) by turning a throttle knob; (b) a momentum and brake simulation circuit 150 which so selectively alters the operator control signal (OPRCON) that the motor 4 moves the train in a manner which simulates the effects of momentum and braking on the acceleration and deceleration of the model train moved by the motor 4; and (c) a logarithmic expansion circuit 152 which so generates the adjusted control signal (ADJCON) from the operator control signal (OPRCON) that an incremental increase in the rotational speed of the output shaft of the motor is more gradual at lower speeds than at higher speeds.

Figure 5A:
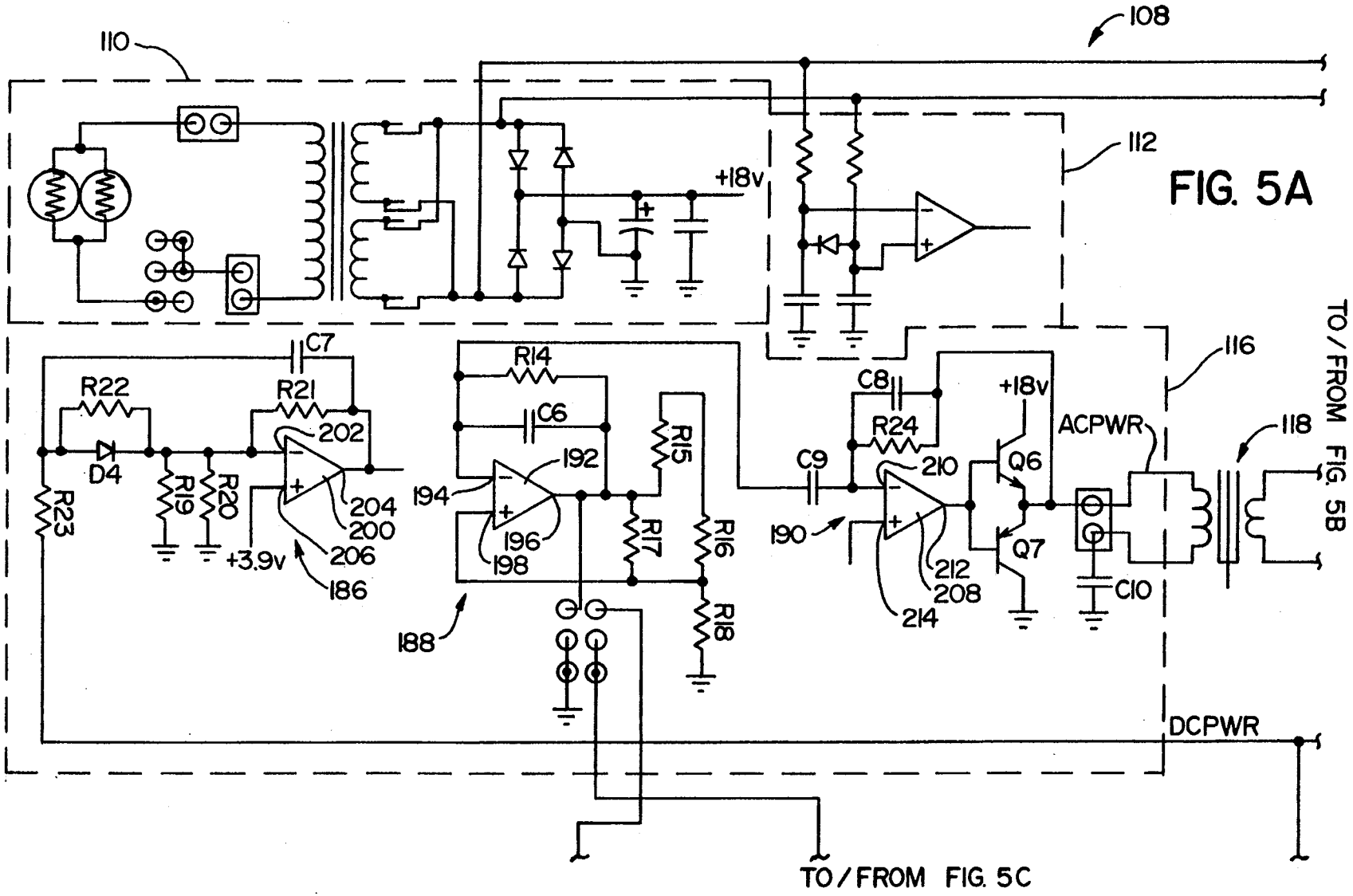
FIG. 5 depicts a schematic diagram of the electrical system of the preferred embodiment.
Figure 5B:
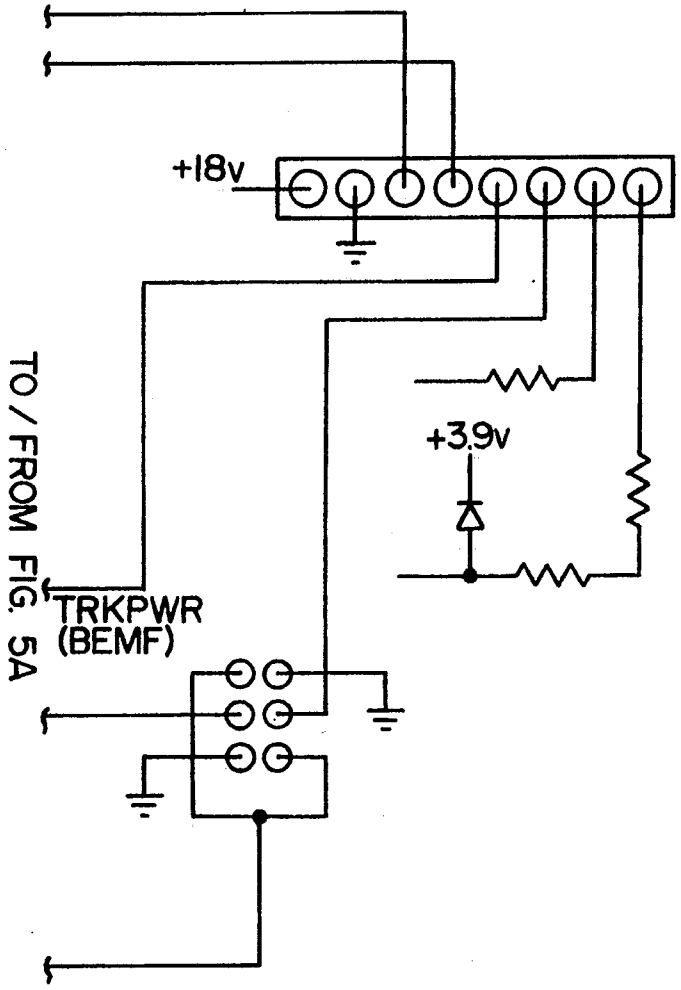
Figure 5C:
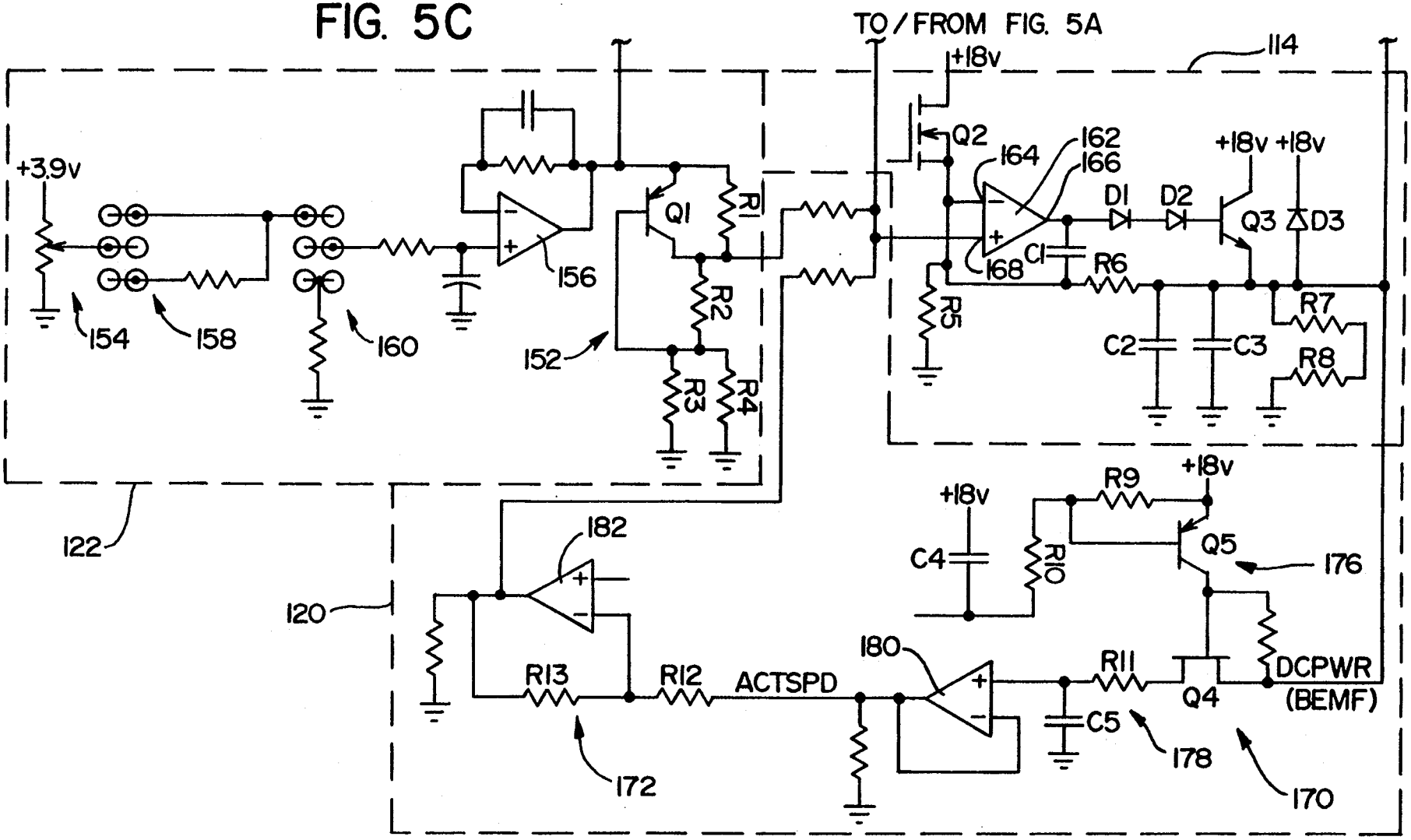

FIG. 5 depicts the speed control circuit 122 in further detail. The throttle control circuit 148 and momentum and brake simulation circuit 150 are similar to those of prior art power packs and will be dealt with only briefly herein.

The throttle control circuit 148 basically comprises a potentiometer 154 and an amplifier 156. By turning a throttle knob of the potentiometer the operator generates the operator control signal (OPRCON) at the output of the amplifier 156. The setting of the throttle knob corresponds to a desired speed of the train. The throttle knob is mounted on a control panel of the controller.

Either or both of a momentum circuit 158 or a braking circuit 160, which comprise the momentum and brake simulation circuit 150, may be selectively connected between the throttle control circuit 154 and the amplifier 156 by pressing corresponding buttons on the control panel. When connected in this manner, these circuits 158 and 160 delay the rise and fall, respectively, of the operator control signal (OPRCON).

The logarithmic expansion circuit 152 so generates the adjusted control signal (ADJCON) based on the operator control signal (OPRCON) that the relationship therebetween is substantially logarithmic. More particularly, the following equation generally sets forth the relationship between these values:

$$Vo = Vref * \frac{(10^{Vi/k} - 1)}{(10^{Vref/k} - 1)} \quad (2)$$

where Vi is the input voltage of the circuit 152, or the operator control signal, Vo is the output voltage of circuit 152, or the adjusted control signal (ADJCON), Vref is a constant reference voltage, and k is a constant. Equation (2) yields a relationship between Vo and Vi whereby the incremental increase in output voltage Vo is larger at smaller values of Vi than for large values of Vi.

In the context of the present invention, placing the logarithmic expansion circuit 152 between the amplifier 156 of the speed control circuit 122 and the output power driver circuit 114 yields incremental increases in the drive control signal (DRVCON), the DC power signal (DCPWR), and the rotational output of the motor 4 that are smaller for smaller values of the operator control signal (OPRCON) than for larger values thereof. This logarithmic expansion circuit 152 thus allows the operator to control precisely the speed of the locomotive at lower speeds, especially in the controller of the present invention in which the speed of the DC motor is Closely regulated by the error correcting circuit 120 as will be described in detail below. It is important that the logarithmic expansion circuit 152 be placed after the momentum and brake simulation circuit 150.

Figure 7:
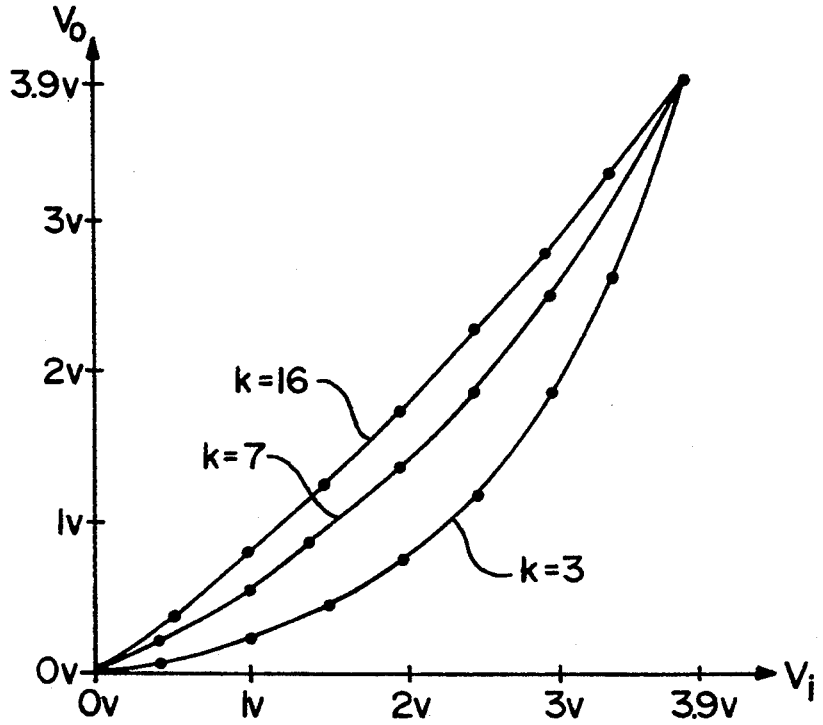
FIG. 7 shows a graph illustrating the relationship between the input voltage and output voltage of a logarithmic expansion circuit of the present invention.

FIG. 7 graphically depicts logarithmic transfer curves representing the relationships between the input voltage Vi and the output voltage Vo for several values of k. It has been found that the controller of the present invention performs optimally with the logarithmic transfer curve generated by k=7.

In the preferred embodiment, with the reference voltage Vref=3.9 V, a logarithmic transfer curve with k=7 is approximated by the logarithmic expansion circuit 152, which comprises a transistor Q1 and resistors R1, R2, R3, and R4 attached thereto. The values of these resistors are chosen so that the transfer curve is formed by two lines L1 and L2, where the slope of the line L1 is smaller than that of the line L2. This approximation of the desired logarithmic transfer curve is cheaper and easier to implement than a true logarithmic transfer curve, while still offering acceptable performance characteristics.

With the logarithmic expansion circuit 152 as described above, the incremental increase in the adjusted control signal (ADJCON), and thus the train speed, is more gradual at lower desired speeds than at higher desired speeds.

II. Output Power Driver Circuit

Referring back to FIG. 5, the output power driver circuit 114 basically comprises: (a) an operational amplifier 162; (b) a transistor Q2 the emitter of which is connected to the negative input terminal 164 of the amplifier 162; (c) resistors R5 and R6 connected to this input terminal 164; (d) a capacitor C1 connected between the input terminal 164 and an output terminal 166 of the amplifier 162; (e) a transistor Q3 the emitter of which is connected to resistor R6; (f) diodes D1 and D2 connected between the output terminal 166 and the base of the transistor Q3; (g) resistors R7 and R8 and capacitors C2 and C3 connected between the emitter of the transistor Q3 and ground; and (h) a diode D3 connected between the emitter of the transistor Q3 and the 18 V reference voltage.

The sense clock signal (SENCLK) is connected to the base of the transistor Q2. The DC power signal (DCPWR) is generated at the emitter of transistor Q3. The drive control signal (DRVQON) is connected to a positive input terminal 168 of the amplifier 162. In operation, as long as the sense clock signal (SENCLK) is at or near ground, the DC power signal (DCPWR) will follow the drive control signal (DRVCON) with a predetermined gain. whenever the sense clock signal (SENCLK) is not at or near ground, the output of the amplifier is inhibited, and the DC power signal (DCPWR) is substantially zero. The clock generating circuit 112 and transistor Q2 together comprise a switching circuit or means for periodically preventing the driver circuit 114 from generating the DC power signal (DCPWR).

The values of resistors R5 and R6 determine the gain of amplifier 162, which is approximately 8 in the preferred embodiment. The capacitor C1 ensures the stability of the stage. Transistor Q3 is a voltage source. Capacitors C2 and C3 provide an AC ground for the transistor Q3. Resistors R7 and R8 ensure proper operation of the stage when no locomotive is placed on the tracks.

Diodes D1 and D2 force the DC power signal (DCPWR) more negative when the output of the amplifier 162 goes low to collapse the magnetic field in the motor more quickly. Until this magnetic field is collapsed, current flows through the armature 4*a* of the motor 4. While this current is flowing, the back EMF signal (BEMF) can not accurately be measured, so this current must quickly be reduced to zero to measure the back EMF signal (BEMF). These diodes D1 and D2 thus quickly eliminate this current when the output of amplifier 168 goes low to ensure accurate measurement of the back EMF signal (BEMF).

So constructed, the output power driver circuit 114 amplifies the drive control signal (DRVCON) with a gain of eight while switching off the DC power signal (DCPWR) whenever the sense clock signal (SENCLK) signal goes high.

III. Error Correcting Circuit

As shown in FIG. 4, the error correcting circuit 120 comprises a speed sensing circuit 170, an error signal generating circuit 172, and a summing node 174. The speed sensing circuit 170 generates an actual speed signal (ACTSPD) indicative of the speed of the locomotive by measuring the back EMF signal (BEMF) generated by the DC motor. The error signal generating circuit 172 generates a speed difference signal (SPDDIF). The speed difference signal (SPDDIF) is the difference between the actual speed signal (ACTSPD) and the adjusted control signal (ADJCON). The speed difference signal (SPDDIF) is then added to the adjusted control signal (ADJCON) at the summing node 174 to generate the drive control signal (DRVCON).

Referring to FIG. 5, the speed sensing circuit 170 basically comprises a gating/delay circuit 176, a J-FET transistor Q4, a storage filter circuit 178, and a buffer amplifier 180.

The gating/delay circuit 176 basically comprises a transistor Q5 connected at is collector to the emitter of transistor Q4, a resistor R9 connected between the emitter and base of transistor Q5, a capacitor C4 connected to the 18 V reference voltage, and a resistor R10 connected between the capacitor C4 and the base of the transistor Q5. A gate signal (GATE) is generated at the collector of transistor Q5.

The sense clock signal (SENCLK) enters the delay circuit 176 at the juncture of the resistor R10 and capacitor C4. The gate signal (GATE) goes LOW a short delay period after the sense clock signal (SENCLK) goes HIGH and goes HIGH at approximately the same time that the sense clock signal (SENCLK) goes to zero, or LOW. The values of resistors R9 and R10 and capacitor C4 determine the length of this delay period. This delay period is approximately 2 milliseconds in the preferred embodiment and will be discussed in further detail below with reference to FIG. 8.

When the gate signal (GATE) goes low, the J-FET transistor Q4 is gated ON. Conversely, when this gate signal is HIGH, the transistor Q4 is gated OFF. Consequently, the transistor Q4 allows only the back EMF signal (BEMF) generated by the armature 4*a* of the motor 4 to enter the storage filter circuit 178; on the other hand, the DC power signal (DCPWR) does not pass through to the storage filter circuit 178.

The storage filter circuit 178, which comprises a resistor R11 and a capacitor C5, filters out noise that may be present on the tracks and thus allows accurate generation of the actual speed signal (ACTSPD) from the back EMF signal (BEMF). In the preferred embodiment, the buffer amplifier 180 has a gain of one.

The actual speed signal (ACTSPD) thus corresponds to the back EMF signal (BEMF) after it has been filtered by the storage filter circuit 178 and buffered by the buffer amplifier 180.

A differential amplifier 182 of the error signal generating circuit 172 then generates a speed difference signal (SPDDIF) as the difference between the actual speed signal (ACTSPD) and the adjusted control signal (ADJCON).

The speed difference signal (SPDDIF) is then added to the adjusted control signal (ADJCON) at the summing node 174. The resulting signal is the drive control signal (DRVQON) used as the input to the output power driver circuit 114 described above.

The error correcting circuit 120 thus corrects the adjusted control signal (ADJCON) based on the back EMF signal (BEMF), which corresponds to the speed of the train.

IV. AC Signal Generating Circuit

As shown in FIG. 4, the AC signal generating circuit 116 comprises a high-frequency carrier driver circuit 184 and a carrier controller circuit 186.

As depicted in FIG. 5, the carrier driver circuit 184 comprises a carrier generator circuit 188 and an AC power driver circuit 190. The generator circuit 188 generates an AC drive signal (ACDRV). The carrier controller circuit 186 generates an AC modulating signal (ACMOD) that is used to modulate the amplitude of the AC drive signal (ACDRV). The AC driver circuit 188 then generates the AC power signal (ACPWR) based on the AC drive signal (ACDRV).

The AC drive signal (ACDRV) generated by the carrier generating circuit 188 is a high-frequency waveform. This circuit 188 comprises an amplifier 192, a resistor R14 and capacitor C6 connected in series between the negative input terminal 194 and output terminal 196 of the amplifier 192, a pull-up resistor R15 connected to the output terminal 196, a resistor R16 connected to the resistor R15, a resistor R17 connected between the output terminal 196 and a positive input terminal 198 of the amplifier 192, and a resistor R18 connected between the input terminal 198 and ground.

The resistor R14 and capacitor C6 cause the amplifier to oscillate with a frequency set by a time constant determined by the values of R14 and C6. In the preferred embodiment, this frequency set by this time constant is as approximately 25 KHz. This time constant should be such that the frequency of oscillation is above the range of human hearing, or approximately 20 KHz, and below the frequency at which the windings of the DC motor 4 become capacitive, or less than approximately 100 KHz.

The resistors R16, R17, and R18 set a positive feedback threshold for the oscillator formed by the amplifier 192, resistor R14, and capacitor C6. Resistor R15 is simply a pull-up resistor.

The carrier controller circuit 186 is designed to control the amplitude of the AC drive signal (ACDRV) such that the voltage level of the combined AC power signal (ACPWR) and the DC power signal (DCPWR) is substantially constant. This circuit 186 basically comprises an operational amplifier 200, resistors R19 and R20 connected between the negative input terminal 202 of the amplifier 200, resistor R21 connected between the input terminal 202 and an output terminal 204, a diode D4 and a resistor R22 are connected in parallel to the input terminal 202, a capacitor C7 connected between the diode D4 and resistor R22 and the output terminal 204, and a resistor R23 connected between the diode D4 and the emitter of transistor Q3 of the DC power driver circuit. The 3.9 V reference voltage is connected to a positive input terminal 206 of the amplifier 200.

In operation, the DC power signal (DCPWR) enters the carrier controller circuit 186 through the diode D4. Ideally, this circuit 186 is designed such that the AC modulating signal (ACMOD) generated at the output terminal 204 of the amplifier 200 is generally inversely proportional to the amplitude of the DC power signal (DCPWR). In the preferred embodiment, the AC modulating signal (ACMOD) is comprised of two straight lines having negative slopes, where the slope of one of these lines is more negative than the slope of the other line.

Resistors R19, R20, and R21 set the initial level of control voltage. Resistors R22 and R23 and diode D4 set the break point where line L3 ends and line L4 begins. The capacitor C7 acts as a filter to cause the circuit 186 to reject any signals over 400 Hz.

The AC modulating signal (ACMOD) enters the carrier generator circuit 188 at the juncture of resistors R15 and R16. The amplitude of the AC drive signal (ACDRV) is thus modulated by the magnitude of the AC modulating signal (ACMOD). Consequently, the amplitude of the AC drive signal (ACDRV) decreases as the amplitude of the DC power signal (DCPWR) increases, and vice versa.

The AC drive circuit 190 generates the AC power signal (ACPWR) based on the AC drive signal (ACDRV). This circuit 190 basically comprises an amplifier 208, a pair of transistors Q6 and Q7 connected in a push-pull configuration with the bases of these transistors Q6 and Q7 connected to the output terminal 210 of the amplifier 208, a capacitor C8 and resistor R24 connected in parallel between a negative input terminal 212 of the amplifier 208 and the emitters of the transistors Q6 and Q7, and a coupling capacitor C9.

The AC drive signal (ACDRV) enters the AC driver circuit 190 through a coupling capacitor C9. The resistor R24 Sets the bias point for the amplifier 208. The capacitor C8 is the primary feedback element, and, in conjunction with capacitor C9, forms a capacitive feedback divider with a gain of 10. A second coupling capacitor C10 is connected between one terminal of the coupling transformer 118 and ground, and the other terminal of the transformer 118 is connected to the emitters of the transistors Q6 and Q7.

Figure 6:
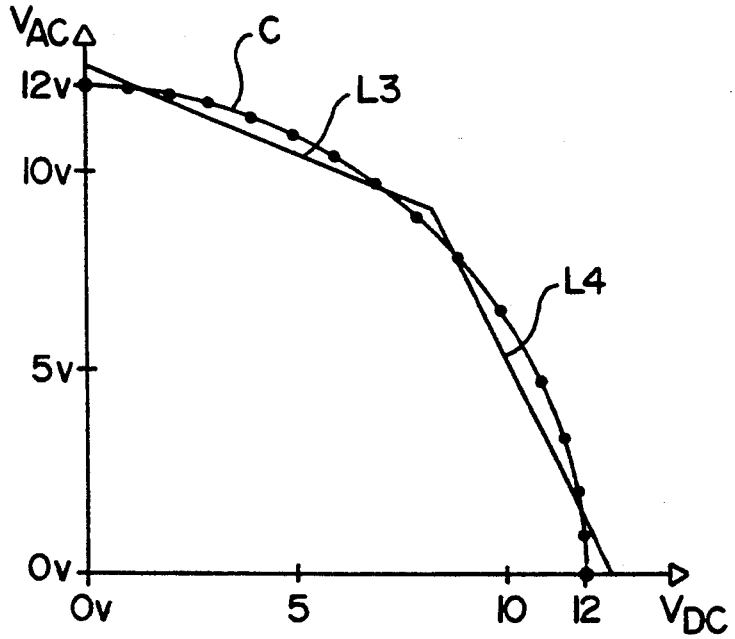
FIG. 6 shows a graph illustrating the relationship between the voltage level of the a DC component of a track drive signal and the amplitude of the voltage level of an AC component of the track drive signal.

As mentioned above, the AC modulating signal (ACMOD) is comprised of two straight lines. These lines are used to approximate the quarter circle curve C of FIG. 6. Therefore, lines L1 and L2 in FIG. 6 depict the relationship between the voltage level of the DC power signal (DCPWR) and the amplitude of the AC power signal (ACPWR) for the preferred embodiment. This two line approximation of the quarter circle has been found to provide acceptable performance in the context of providing power to a model train locomotive.

V. Operation

Figures 8A, 8B, 8C, 8D, 8E, 8F:
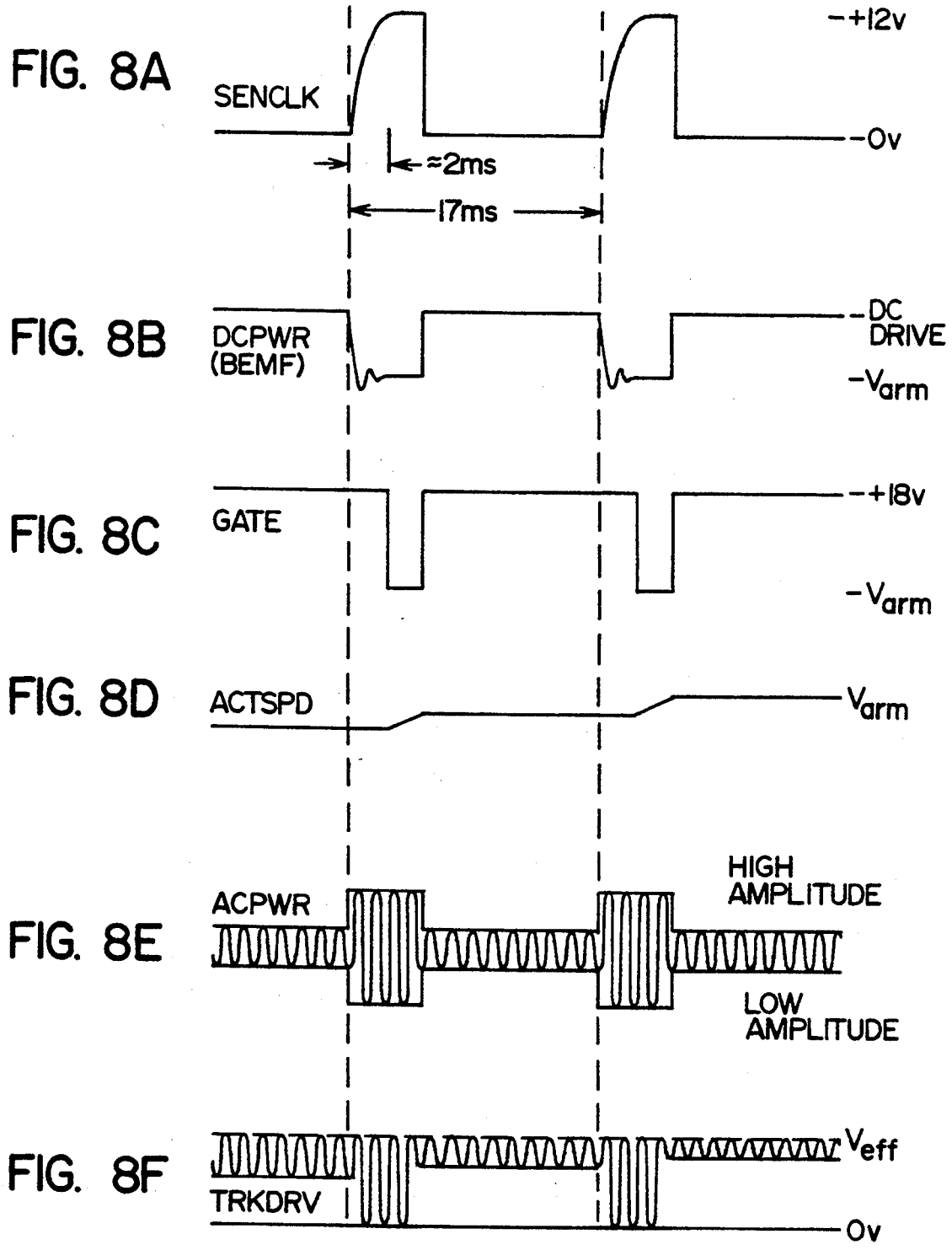
FIGS. 8(A)–8(F) show a timing diagram depicting the relationships between various signals generated by the electrical system of the present invention.

FIG. 8 depicts the waveforms generated at various points in the system just described and the timing between these waveforms. FIG. 8A depicts the sense clock signal (SENCLK) generated by the sense clock circuit 112. FIG. 8B depicts the DC power signal (DCPWR) created at the emitter of transistor Q3 of the output power driver circuit 114. As depicted, when the sense clock signal (SENCLK) goes high, the DC power signal (DCPWR) falls to the armature voltage of the motor 4.

The back EMF signal (BEMF) is used by the speed sensing circuit 170 to generate the actual speed signal (ACTSPD). However, to allow the back EMF signal (BEMF) to stabilize, the gating circuit 176 delays the generation of the actual speed signal (ACTSPD) for the 2 milliseconds delay period described above. The gating signal (GATE) is depicted in FIG. 8C. FIG. 8D depicts an example of the actual speed signal (ACTSPD) for a situation in which the locomotive is being accelerated.

The AC power signal (ACPWR) generated at the emitters of transistors Q6 and Q7 is depicted in FIG. 8E. As is shown in FIG. 8E, during the periods when the DC power signal (DCPWR) falls in response to the sense clock signal (SENCLK), the amplitude of the AC power signal (ACPWR) increases to ensure that the total power supplied to the filament of lamp 6 is substantially constant over time. Moreover, the lowest amplitude of the AC power signal (ACPWR) is determined by the magnitude of the DC power signal (DCPWR): when the DC power signal (DCPWR) decreases, the lowest amplitude of the AC power signal (ACPWR) increases; when the DC power signal (DCPWR) increases, the lowest amplitude of the AC power signal (ACPWR) decreases.

Finally, the track drive signal (TRKDRV) is depicted in FIG. 8F. As shown in that figure, the effective voltage Veff is substantially constant over time.

As mentioned above, DC motors ignore AC signals, and the motor 4 is thus energized by the DC component but is not affected by the AC component. The filament *6a* of the lamp 6, however, is energized by both components, and the temperature, and therefore resistance, of this filament *6a* is stabilized.

From the foregoing, it should be clear that the present invention may be embodied in forms other than the one disclosed above without departing from the spirit or essential characteristics of the present invention. The above-described embodiment is therefore to be considered in all respects illustrative and not restrictive, the scope of the invention being indicated by the appended claims rather than the foregoing description. All changes that come within the meaning and scope of the claims are intended to be embraced therein.

I claim:

1. A controller apparatus for a DC motor of a model locomotive, comprising:

a. means for generating a DC power signal, where the DC power signal energizes the DC motor to move the locomotive;

b. means for determining a speed of the locomotive by measuring a back EMF signal generated by the DC motor; and c. means for correcting the DC power signal based on the speed of the locomotive; and d. means for setting a desired speed signal based on a desired speed of the locomotive; wherein the speed determining means generates an actual speed signal indicative of the actual speed of the locomotive; and the correcting means (i) generates a difference signal corresponding to a difference between the actual speed signal and the desired speed signal, and (ii) adds the difference signal to the desired speed signal to generate a drive control signal, where the DC power signal generating means generates the DC power signal based on the drive control signal.

2. An apparatus as recited in claim 1, further comprising:

a. means for setting a speed signal signal corresponding to the desired speed of the locomotive; and b. means for so generating the desired speed signal based on the speed signal that an increase in the drive control signal per unit of speed is smaller at lower desired speeds than at higher desired speeds.

3. An apparatus as recited in claim 1, in which the locomotive further comprises a lamp having a filament electrically connected in parallel with the DC motor, the apparatus further comprising stabilizing means for providing constant power to the filament for the purpose of stabilizing the resistance of the filament.

4. An apparatus as recited in claim 3, in which the stabilizing means comprises:

a. means for generating an AC power signal; and b. means for so adding the AC power signal to the DC power signal to form the track drive signal that the AC component of the track drive signal energizes the filament.

5. An apparatus as recited in claim 4, further comprising means for so modulating the amplitude of the AC power signal based on the magnitude of the DC power signal that the total power supplied to the filament is substantially constant over time.

6. An apparatus as recited in claim 4, in which a frequency of the AC power signal is above the range of frequencies audible to human hears and below the range in which the DC motor becomes capacitive.

7. An apparatus as recited in claim 1, further comprising switching means for periodically preventing the DC power signal from controlling the DC motor, where the means for determining the speed of the locomotive measures the back EMF signal during the time that the switching means prevents the DC power signal from energizing the DC motor.

8. An apparatus as recited in claim 7, in which the switching means periodically prevents the DC power signal from controlling the motor and the DC power signal is prevented from energizing the DC motor for between 20% and 50% of this period.

9. An apparatus as recited in claim 7, in which the speed determining means determines the speed of the locomotive a predetermined delay period after the beginning of each period during which the switching means prevents the DC power signal from controlling the DC motor.

10. A controller apparatus for a DC motor and a lamp having a filament electrically connected in parallel with the DC motor, comprising:

a. means for generating a DC power signal, where the DC power signal energizes the DC motor;

b. means for generating an AC power signal;

c. means for so adding the AC power signal to the DC power signal that the AC and DC power signals energize the filament; and d. means for so modulating the AC power signal that the total mower supplied to the filament is substantially constant over time.

11. An apparatus as recited in claim 10, further comprising means for so modulating the amplitude of the AC power signal based on the magnitude of the DC power signal that the total power supplied to the filament is substantially constant over time.

12. An apparatus as recited in claim 10, in which a frequency of the AC power signal is above the range of frequencies audible to human hearing and below the range in which the DC motor becomes capacitive.

13. An apparatus as recited in claim 10, further comprising:

a. switching means for periodically preventing the DC power signal from controlling the DC motor;

b. means for determining a speed of the locomotive by measuring a back EMF signal generated by the DC motor during the time that the switching means prevents the DC power signal from controlling the DC motor; and c. means for correcting the DC power signal based on the speed of the locomotive.

14. The apparatus of claim 13, further comprising means for setting an operator control signal corresponding to a desired speed of the locomotive, wherein:

a. the speed determining means generates an actual speed signal indicative of the actual speed of the locomotive; and b. the correcting means i. generates a difference signal corresponding to a difference between the actual speed signal and the operator control signal, and ii. adds the difference signal to the operator control signal to generate a drive control signal; wherein the DC power signal generating means generates the DC power signal based on the drive control signal.

15. A method of providing power to a scale model locomotive having a DC motor, comprising the steps of:

a. generating a DC power signal based on a speed signal, where the DC power signal energizes the DC motor;

b. generating an actual speed signal indicative of a speed of the locomotive, where the actual speed signal is generated by measuring a back EMF signal generated by the DC motor;

c. adjusting the speed signal based on the actual speed signal; and d. setting a desired speed signal based on a desired speed of the locomotive; wherein e. the step of adjusting the speed control signal comprises the steps of (i) determining a difference signal corresponding to a difference between the actual Speed signal and the desired speed signal, and (ii) adding the difference signal to the desired speed signal to generate the speed signal.

16. A method as recited in claim 15, further comprising the steps of:

a. setting a speed signal corresponding to a desired speed of the locomotive; and b. so generating the desired speed signal based on the speed signal that an increase in the desired speed signal per unit of speed is smaller at lower desired speeds than at higher desired speeds.

17. A method as recited in claim 15, in which the locomotive further comprises a lamp having a filament electrically connected in parallel with the DC motor, the method further comprising the step of stabilizing the resistance of the filament by providing constant power to the filament.

18. A method as recited in claim 17, in which the step of stabilizing the resistance of the filament comprises the steps of:

a. generating an AC power signal; and b. so adding the AC power signal to the DC power signal that the AC power signal energizes the filament regardless of the magnitude of the DC power signal.

19. A method as recited in claim 18, further comprising the step of so modulating the amplitude of the AC power signal based on the magnitude of the DC power signal that the total power supplied to the filament is substantially constant over time.

20. A method as recited in claim 15, further comprising the step of periodically preventing the DC power signal from controlling the DC motor, where the back EMF signal is measured during the time that the the DC power signal is prevented from energizing the DC motor.

21. A controller apparatus for a scale model locomotive comprising: (a) a DC motor having an armature; (b) a lamp having a filament electrically connected in parallel with the armature of the DC motor; and (c) wheels electrically connected in parallel with the armature of the DC motor, where wheels of the locomotive ride on conductive tracks, the controller-apparatus comprising:

a. throttle control means for setting an operator control signal corresponding to a desired speed of the locomotive; and b. logarithmic expansion means for so adjusting the operator control signal that an incremental increase in the operator control signal is more gradual at lower desired speeds than at higher desired speeds;

c. power signal generating means for generating a DC power signal based on a drive control signal, where the power signal generating means are electrically connected to the tracks to control the DC motor;

d. switching means for periodically turning off the power signal generating means to prevent the DC power signal from controlling the DC motor;

e. speed determining means for generating an actual speed signal indicative of a speed of the locomotive, where the actual speed signal is generated from a back EMF signal measured across the armature of the DC motor during the period in which the DC power signal is prevented from controlling the DC motor;

f. means for determining a difference signal corresponding to a difference between the actual speed signal and the operator control signal;

g. means for adding the difference signal to the desired speed signal to generate the drive control signal;

h. means for generating an AC power signal;

i. means for adding the AC power signal to the DC power signal to create a track drive signal, where the AC component of the track drive signal energizes the filament; and j. means for so modulating the amplitude of the AC power signal based on the magnitude of the DC power signal that the total power supplied to the filament by the track drive signal is substantially constant over time.

22. An apparatus as recited in claim 21, further comprising:

a. momentum simulating means that may be selectively connected between the throttle control means and logarithmic expansion means for delaying the rise of the operator control signal to simulate the effects of momentum on the motion of the locomotive; and b. brake simulating means that may be selectively connected between the throttle control means and the logarithmic expansion means for delaying the fall of the operator control signal to simulate the effects of braking on the motion of the locomotive.

* * * * *